US007438377B2

(12) United States Patent
Kubo

(10) Patent No.: US 7,438,377 B2
(45) Date of Patent: Oct. 21, 2008

(54) INK JET RECORDING APPARATUS

(75) Inventor: Tomoyuki Kubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 349 days.

(21) Appl. No.: 11/018,737

(22) Filed: Dec. 20, 2004

(65) Prior Publication Data

US 2005/0140741 A1 Jun. 30, 2005

(30) Foreign Application Priority Data

Dec. 24, 2003 (JP) ..... 2003-426142

(51) Int. Cl.
*B41J 29/377* (2006.01)
*B41J 2/045* (2006.01)

(52) U.S. Cl. ..... 347/18; 347/68

(58) Field of Classification Search ..... 347/18, 347/50, 68

See application file for complete search history.

(56) References Cited

U.S. PATENT DOCUMENTS

| | | | | |
|---|---|---|---|---|
| 6,007,176 | A * | 12/1999 | Askren et al. | 347/18 |
| 6,076,912 | A * | 6/2000 | Murthy | 347/18 |
| 6,679,595 | B2 | 1/2004 | Yamada | |
| 2003/0063449 | A1 | 4/2003 | Suzuki | |
| 2003/0117464 | A1 * | 6/2003 | Miyata | 347/71 |

FOREIGN PATENT DOCUMENTS

| | | |
|---|---|---|
| JP | A-2002-240306 | 8/2002 |
| JP | A-2003-80793 | 3/2003 |

* cited by examiner

*Primary Examiner*—Stephen D Meier
*Assistant Examiner*—Geoffrey Mruk
(74) *Attorney, Agent, or Firm*—Reed Smith LLP

(57) ABSTRACT

An ink jet recording apparatus, including nozzles each of which ejects a droplet of ink toward a recording sheet and which are arranged in one or more arrays in a first direction; pressure changing devices each of which changes a pressure of the ink to be supplied to a corresponding one of the nozzles so that the one nozzle ejects the droplet of ink, wherein the pressure changing devices are grouped into two groups arranged in a second direction perpendicular to the first direction; two flexible wiring cables which are electrically connected to the two groups of pressure changing devices, respectively, and which extend from the two groups of pressure changing devices in opposite directions, respectively, parallel to the second direction; two driver circuits which are provided on, and electrically connected to, the two wiring cables, respectively, and each of which outputs respective drive signals to drive the respective pressure changing devices of a corresponding one of the two groups; and a heat sink including two heat-conducting side walls which are opposite to each other in the second direction, a portion of each one of the two side walls contacting a corresponding one of the two driver circuits, and a heat-conducting connection portion which extends in the second direction and connects between the two side walls.

23 Claims, 8 Drawing Sheets

INK JET RECORDING APPARATUS

The present application is based on Japanese Patent Application No. 2003-426142 filed on Dec. 24, 2003, the contents of which are incorporated herein by reference.

BACKGROUND OF THE INVENTION

1. Field of the Invention

The present invention relates to an ink jet recording apparatus and in particular to such an ink jet recording apparatus having a construction in which heat generated by a driver circuit that outputs a drive signal used to eject a droplet of ink is radiated by a heat sink.

2. Related Art Statement

Patent Document 1 (Japanese Patent Application Publication P2002-240306 or its corresponding U.S. Pat. No. 6,679,595B2) or Patent Document 2 (Japanese Patent Application Publication P2003-080793 or its corresponding U.S. Patent Application Publication No. 2003-063449A1) discloses an ink jet recording apparatus including two recording heads that eject droplets of ink and cooperate with each other to record an image on a recording medium. Each of the recording heads includes a plurality of ink ejection nozzles arranged in an array; a cavity unit that has a plurality of pressure chambers corresponding to the ink ejection nozzles, respectively, and has a generally rectangular, stacked structure; and a piezoelectric actuator unit that is stacked on, and adhered to, the cavity unit and has a plurality of piezoelectric actuators (i.e., a plurality of pressure changing devices) corresponding to the pressure chambers, respectively. The ink jet recording apparatus additionally includes two flexible flat cables (i.e., two flexible wiring cables) which are stacked on the respective piezoelectric actuator units of the two recording heads and each of which has a plurality of electric wirings that are electrically connected to the piezoelectric actuators of the piezoelectric actuator unit of a corresponding one of the two recording heads.

Two IC chips (i.e., two driver circuits) each of which outputs a drive signal to a corresponding one of the two recording heads so as to eject a droplet of ink from an arbitrary one of the ink ejection nozzles of the one recording head, are provided on the two flexible flat cables, respectively. The two flexible flat cables extend in a same direction parallel to the direction in which the respective arrays of ink ejection nozzles of the two recording heads extend. Thus, the two IC chips are located adjacent each other. In addition, the two IC chips contact a common heat sink, which radiates the heat generated by the chips.

SUMMARY OF THE INVENTION

However, in the above-indicated ink jet recording apparatus, the flexible flat cables extend in the direction parallel to the direction of extension of the arrays of nozzles and accordingly each of the flexible flat cables has its width in a direction substantially perpendicular to the direction of extension of the arrays of nozzles. Thus, each of the flexible flat cables cannot have a sufficiently great width. Meanwhile, recently there has been such a tendency that a greater number of nozzles are employed to record, at a higher density, an image on a recording medium and that an increased number of electric wirings are employed by each of the flexible flat cables so as to connect between a corresponding one of the IC chips and a corresponding one of the piezoelectric actuator units. Thus, in the conventional recording apparatus in which the flexible flat cables extend in the direction parallel to the direction of extension of the arrays of nozzles, each of the flexible flat cables needs to have the increased number of electric wirings within the considerably small width. That is, each of the flexible flat cables needs to have the electric wirings at a higher density. This means that in each of the flexible flat cables, the electric wirings need to be formed at higher accuracy and difficulty, and that the production cost of the ink jet recording apparatus is increased.

In this technical background, the Inventor has had an idea to provide such a structure in which two flexible flat cables are extended from two recording heads in opposite directions, respectively, that are substantially perpendicular to a direction of extension of respective arrays of nozzles of the two recording heads. In this structure, each of the two flexible flat cables can have a sufficiently great with. However, since the two flexible flat cables extend in the opposite directions, respectively, two IC chips need to be located at respective positions remote from each other. Thus, when only one of the two recording heads continuously eject droplets of ink, a great temperature difference is produced between the two IC chips, so that respective signal-outputting characteristics of the two IC chips, e.g., respective timings of rise and fall of respective pulse signals (i.e., respective drive signals) outputted by the two IC chips, are changed. Consequently respective ink-ejecting characteristics of the respective arrays of nozzles of the two recording heads corresponding to the two IC chips are changed, and the quality of recording of the ink jet recording apparatus is lowered.

It is therefore an object of the present invention to provide an ink jet recording apparatus which is free of at least one of the above-identified problems. It is another object of the present invention to provide such an ink jet recording apparatus which can allow two wiring cables to be easily extended from two recording heads to two driver circuits, respectively, even if a total number of nozzles of each of the recording heads may be increased, and which can reduce a temperature difference produced between the two driver circuits, so as to prevent the changing of respective ink-ejecting characteristics of respective arrays of nozzles of the two recording heads corresponding to the two driver circuits, and record an image with a high quality.

According to the present invention, there is provided an ink jet recording apparatus an ink jet recording apparatus, comprising: a plurality of nozzles each of which ejects a droplet of at least one sort of ink toward a recording medium and which are arranged in at least one array in a first direction; a plurality of pressure changing devices which correspond to the nozzles, respectively, and each of which changes a pressure of the at last one sort of ink to be supplied to a corresponding one of the nozzles so that the one nozzle ejects the droplet of the at least one sort of ink, wherein the pressure changing devices are grouped into two groups which are arranged in a second direction substantially perpendicular to the first direction; two flexible wiring cables which are electrically connected to the two groups of pressure changing devices, respectively, and which extend from the two groups of pressure changing devices in opposite directions, respectively, that are parallel to the second direction; two driver circuits which are provided on, and electrically connected to, the two wiring cables, respectively, and each of which outputs respective drive signals to drive the respective pressure changing devices of a corresponding one of the two groups; and a heat sink including two heat-conducting side walls which are opposite to each other in the second direction, a portion of each one of the two side walls contacting a corresponding one of the two driver circuits, and a heat-conducting connection portion which extends in the second direction and connects between the two side walls. The nozzles may be arranged in a single array in the first direction.

In the ink jet recording apparatus according to the present invention, the nozzles are arranged in one or more arrays extending in the first direction, and the pressure changing devices are grouped into the two groups that are arranged in the second direction substantially perpendicular to the first direction. The two flexible wiring cables are electrically connected to the two groups of pressure changing devices, respectively, and extend from the two groups of pressure changing devices in the opposite directions, respectively, that are parallel to the second direction. Therefore, the wiring cables can have respective widths corresponding to a length or respective lengths of the array or arrays of nozzles in the first direction. Thus, even if the total number of the nozzles employed may be increased, the density of electric wires of each wiring cable need not be increased in contrast to the above-indicated conventional ink jet recording apparatus. Consequently the wiring cables can be easily formed and accordingly the production cost of the wiring cables can be reduced.

In addition, the two driver circuits are provided on the two wiring cables, respectively, that extend from the two groups of pressure changing devices in the opposite directions, respectively, that are parallel to the second direction, and the heat sink includes the two side walls that contact the two driver circuits, respectively, and the connection portion that connects between the two side walls. Therefore, the heat sink can prevent the temperature of each of the driver circuits from being excessively increased by the heat generated thereby, and can reduce a temperature difference produced between the two driver circuits. Consequently the heat sink can restrain respective changes of respective signal-outputting characteristics of the two driver circuits and can reduce a difference of the respective signal-outputting characteristics of the same. Thus, respective ink-ejecting characteristics of the respective nozzles corresponding to the two driver circuits can be kept substantially equal to each other, and accordingly an image can be recorded with a high quality.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
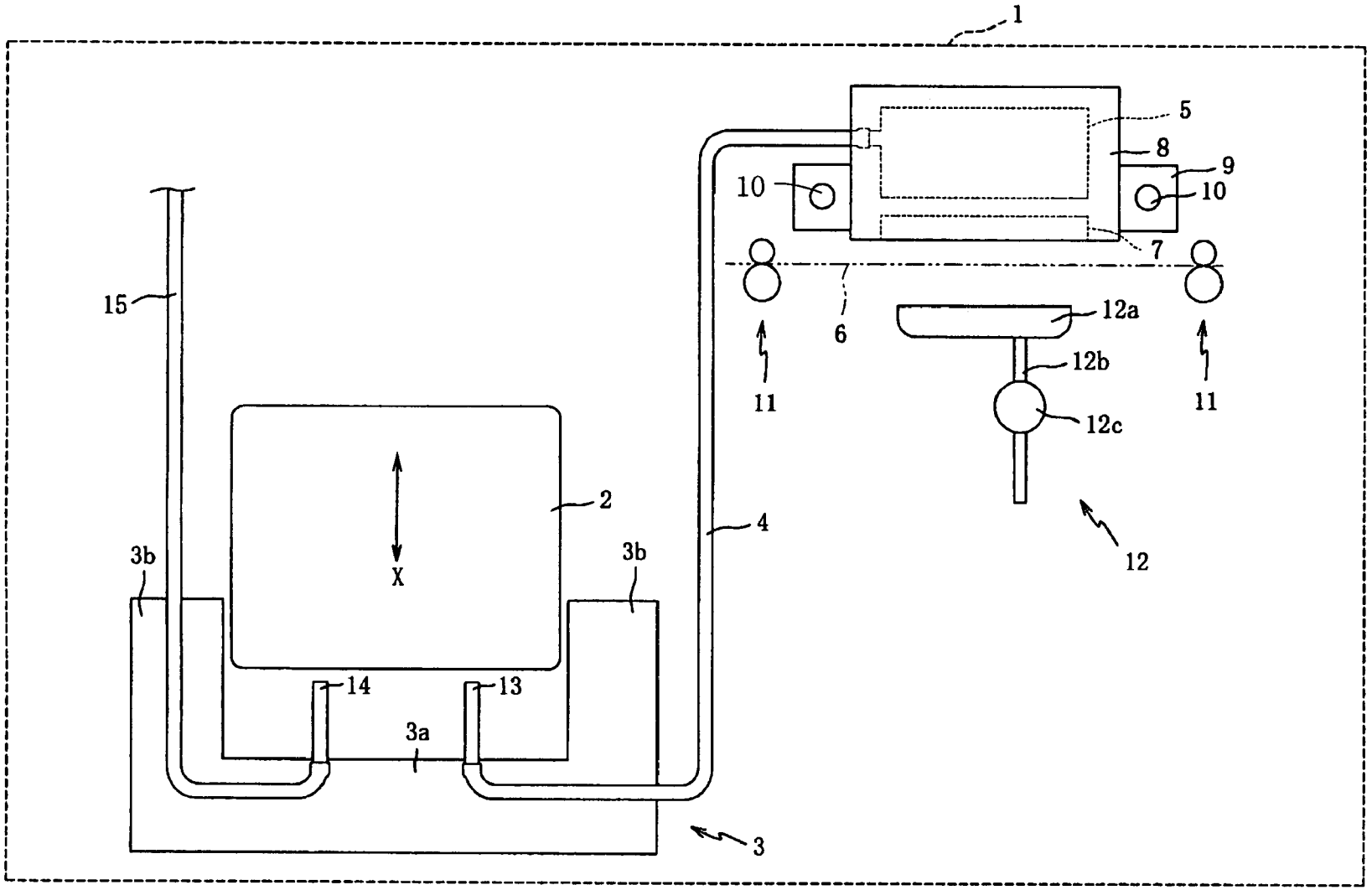
FIG. 1 is a schematic view of an ink jet recording apparatus as a first embodiment of the present invention.

Hereinafter, there will be described preferred embodiments of the present invention by reference to the drawings. FIG. 1 shows an ink jet recording apparatus as a first embodiment of the present invention. The recording apparatus includes four ink cartridges 2 (only one cartridge 2 is shown) that store respective different color inks.

The ink jet recording apparatus includes a housing 1, indicated by broken line; an ink cartridge supporting member 3 that supports the ink cartridges 2 such that each of the cartridges 2 is attachable to, and detachable from, the supporting member 3 in directions indicated by arrow X; four ink supply tubes 4; four buffer tanks 5 that accommodate the four color inks, respectively, that are supplied from the four ink cartridges 2 via the four ink supply tubes 4, respectively; two recording heads 7 that cooperate with each other to eject respective droplets of the four color inks accommodated by the four ink tanks 5, toward a recording sheet 6 as a sort of recording medium; a recording head unit 8 including the four buffer tanks 5 and the two recording heads 7; a carriage 9 that is reciprocated along a straight line and that supports the recording head unit 8; two carriage guide bars 10 that cooperate with each other to guide the reciprocation of the carriage 9; a feeding device 11 that feeds the recording sheet 6; and a purging device 12.

The four ink cartridges 2 store the four color inks, i.e., a magenta ink, a yellow ink, a cyan ink, and a black ink, respectively, and are used in the ink jet recording apparatus to record a full-color image on the recording sheet 6.

The ink cartridge supporting member 3 includes four holding portions each of which includes a base portion 3*a* and two guide portions 3*b* that project upward from two opposite ends of the base portion 3*a*, respectively. The base portion 3*a* supports a first hollow connection pipe 13 such that the connection pipe 13 projects upward and is connected to a corresponding one of the ink cartridges 2 so as to conduct the color ink stored by the ink cartridge 2, to a corresponding one of the ink supply tubes 4; and a second hollow connection pipe 14 that projects upward and is connected to an air introducing tube 15 so as to introduce an ambient air into the corresponding ink cartridge 2.

The four first connection pipes 13 are connected at respective one ends thereof to the four ink supply tubes 4, and communicate with the four buffer tanks 5 via the four ink supply tubes 4. The four second connection pipes 14 are connected at respective one ends thereof to the four air introducing tubes 15, and communicate with the ambient air via the four air introducing tubes 15.

The purging device 12 is provided in an area outside a recording area where the recording heads 7 record the image on the recording sheet 6, such that the purging device 12 can face the recording heads 7. The purging device 12 includes a purging cap 12*a* that can cover respective nozzle supporting surfaces of the two recording heads 7 that support ink ejection nozzles 16 (FIG. 3); a waste ink conducting tube 12*b* that communicates with the purging cap 12*a*; and a pump 12*c* that sucks waste color inks from the nozzles 16 via the waste ink conducting tube 12*b*.

Next, there will be described a construction of the recording head unit 8 by reference to FIGS. 2 and 3.

The recording head unit 8 includes the four buffer tanks 5 and the two recording heads 7, as described above. In addition, the recording head unit 8 includes a head holder 20 in which the buffer tanks 5 are provided, and which supports the recording heads 7; and a printed circuit board 21 that is provided on top of the head holder 20 and is connected via a flexible cable, not shown, to a stationary control circuit, not shown, provided in the housing 1 of the ink jet recording apparatus.

The two recording heads 7 (7*a*, 7*b*) are supported by a bottom wall 20*a* of the head holder 20, such that the two recording heads 7*a*, 7*b* are opposed to the recording sheet 6. Each of the two recording heads 7*a*, 7*b* has four arrays of nozzles 16 extending parallel to each other in a first direction, and the two heads 7*a*, 7*b* are arranged in a second direction substantially perpendicular to the first direction, such that the four arrays of nozzles 16 (16*m*, 16*y*) of the first head 7*a* extend parallel to the four arrays of nozzles 16 (16*c*, 16*k*) of the second head 7*b*. The first recording head 7*a* has the two arrays of nozzles 16*m* corresponding to the magenta ink, and the two arrays of nozzles 16*y* corresponding to the yellow ink; and the second recording head 7*b* has the two arrays of nozzles 16*c* corresponding to the cyan ink, and the two arrays of nozzles 16*k* corresponding to the black ink. The two arrays of nozzles 16 (16*m*, 16*y*, 16*c*, 16*k*) corresponding to each of the four color inks are arranged in a zigzag or staggered fashion. The carriage 9 is reciprocated in the above-indicated second direction.

The four buffer tanks 5 include an ink tank 5*m* accommodating the magenta ink; an ink tank 5*y* accommodating the yellow ink; an ink tank 5*c* accommodating the cyan ink; and an ink tank 5*k* accommodating the black ink. The four buffer tanks 5*m*, 5*y*, 5*c*, 5*k* are connected via respective connection pipes 31*m*, 31*y*, 31*c*, 31*k* to respective ink supply inlets 30*m*, 30*y*, 30*c*, 30*k* (described later) of the two recording heads 7*a*, 7*b*.

The head holder 20 includes a first pair of opposite side walls 20*b* and a second pair of opposite side walls 20*c* that vertically extend and cooperate with each other to define a generally box-like configuration; and the bottom wall 20*a* that is provided in an inner space of the head holder 20 such that the bottom wall 20*a* separates the inner space into a first space 22 in which the two recording heads 7*a*, 7*b* are provided and a second space 23 in which the four buffer tanks 5*m*, 5*y*, 5*c*, 5*k* are provided.

A closure member 24 is fixedly adhered to a lower open end of the head holder 20, so as to close the first space 22. The closure member 24 has two openings through which the two recording heads 7*a*, 7*b* having the nozzles 16*m*, 16*y*, 16*c*, 16*k* are exposed to an outside space. The recording heads 7*a*, 7*b* are adhered with adhesive, not shown, to a lower surface of the bottom wall 20*a* of the head holder 20.

Figure 4:
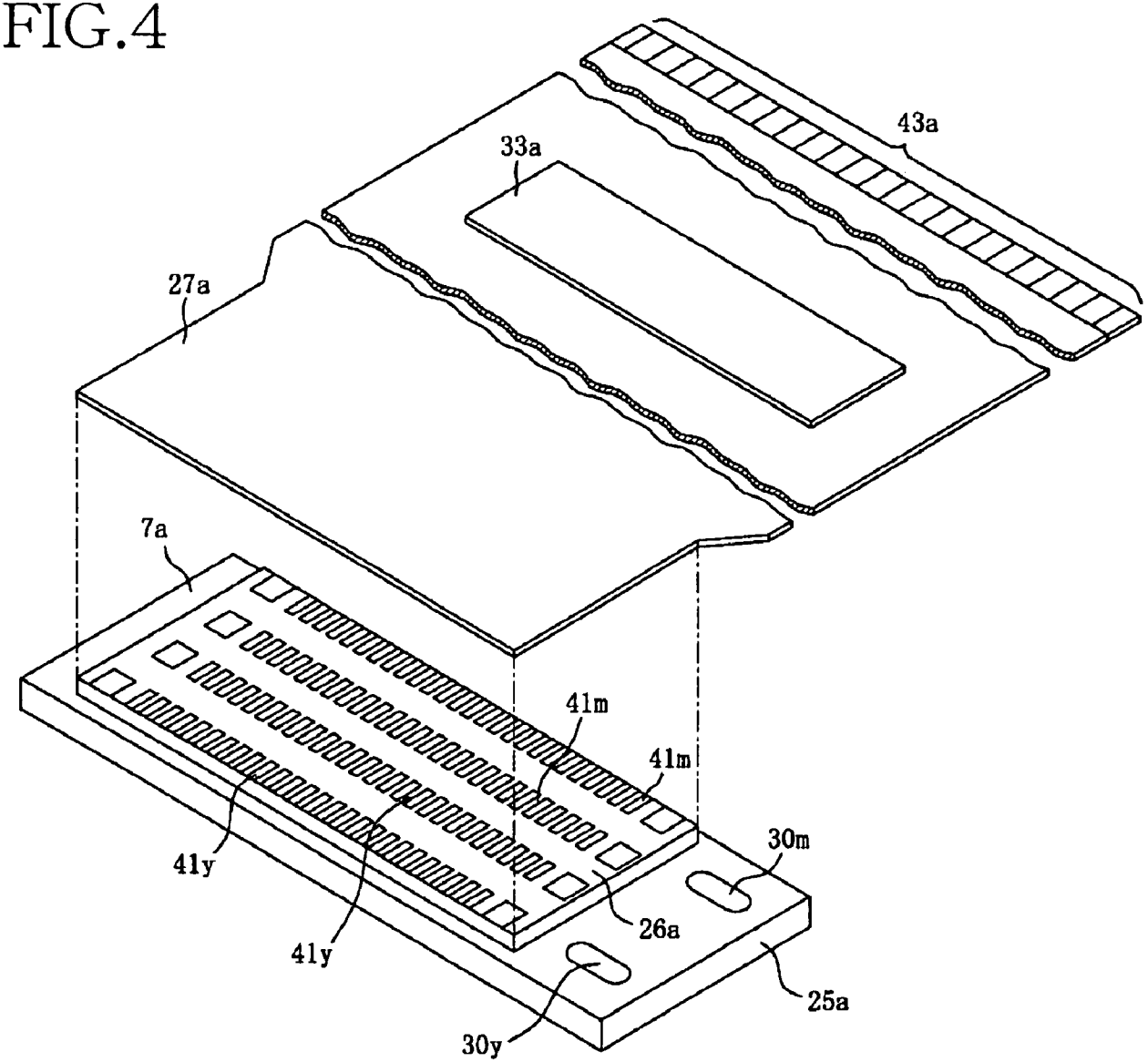
FIG. 4 is an exploded, perspective view of a recording head and a flexible flat cable of the recording head unit.

The two recording heads 7*a*, 7*b* include respective cavity units 25*a*, 25*b* each of which is constituted by a plurality of sheet members stacked on each other; and respective sheet-type piezoelectric actuator units 26*a*, 26*b*. Like the cavity units disclosed by the above-indicated Patent Document 1 or well known in the art, the two cavity units 25*a*, 25*b* cooperate with each other to have, in respective upper surfaces thereof, the four ink supply inlets 30*m*, 30*y*, 30*c*, 30*k*. Each of the four color inks is supplied from a corresponding one of the four ink supply inlets 30*m*, 30*y*, 30*c*, 30*k* to a corresponding one group of pressure chambers out of four groups of pressure chambers, not shown, via a corresponding one of four manifold (or common) chambers, and is further supplied from the one group of pressure chambers to a corresponding one group of nozzles out of the four groups of nozzles 16*m*, 16*y*, 16*c*, 16*k*. The two piezoelectric actuator units 26*a*, 26*b* have four groups of piezoelectric deformable portions, each functioning as a pressure changing device, that correspond to the four groups of pressure chambers. As shown in FIG. 4, the first actuator unit 26*a* has, on an upper surface thereof, two groups of electrodes 41*m*, 41*y* that are electrically connected to the corresponding two groups of piezoelectric deformable portions. Likewise, the second actuator unit 26*b* has, on an upper surface thereof, two groups of electrodes, not shown, that are electrically connected to the other, two groups of piezoelectric deformable portions. Two flexible flat cables 27*a*, 27*b* are stacked on respective upper surfaces of the two piezoelectric actuator units 26*a*, 26*b*, such that the two groups of electrodes 41*m*, 41*y* of the first actuator unit 26*a* are connected via respective electric wires, not shown, of a first one 27*a* of the two flat cables to a first one 33*a* of two IC chips 33*a*, 33*b*, and the two groups of electrodes of the second actuator unit 26*b* are connected via respective electric wires, not shown, of the second flat cable 27*b* to the other IC chip 33*b*. The two IC chips 33*a*, 33*b* are mounted on the two flexible flat cables 27*a*, 27*b*, respectively, and incorporate respective driver circuits, not shown. When the driver circuits of the two IC chips 33*a*, 33*b* supply a drive pulse to an arbitrary one of the piezoelectric deformable portions of the two piezoelectric actuator units 26*a*, 26*b*, the piezoelectric deformable portion is deformed to change the pressure of the ink accommodated in a corresponding one of the pressure chambers, so that a droplet of the ink is ejected from a corresponding one of the nozzles 16.

In the present embodiment, the recording head unit 8 employs the two separate recording heads 7*a*, 7*b* arranged in the second direction, such that the pressure changing devices (i.e., the piezoelectric deformable portions) of the two heads 7*a*, 7*b* are grouped into two groups arranged in the second direction. However, the two cavity units 25*a*, 25*b* may be formed integrally with each other, while the two piezoelectric actuator units 26*a*, 26*b* are formed separately from each other. Alternatively, the two piezoelectric actuator units 26*a*, 26*b* may be formed integrally with each other, while all the electrodes 41 provided on the upper surface of the integral piezoelectric actuator unit 26 are separated into two groups that are arranged in the second direction perpendicular to the first direction in which the arrays of nozzles 16 extend, and that are connected to the two flexible flat cables 27*a*, 27*b*, respectively.

Figure 2:
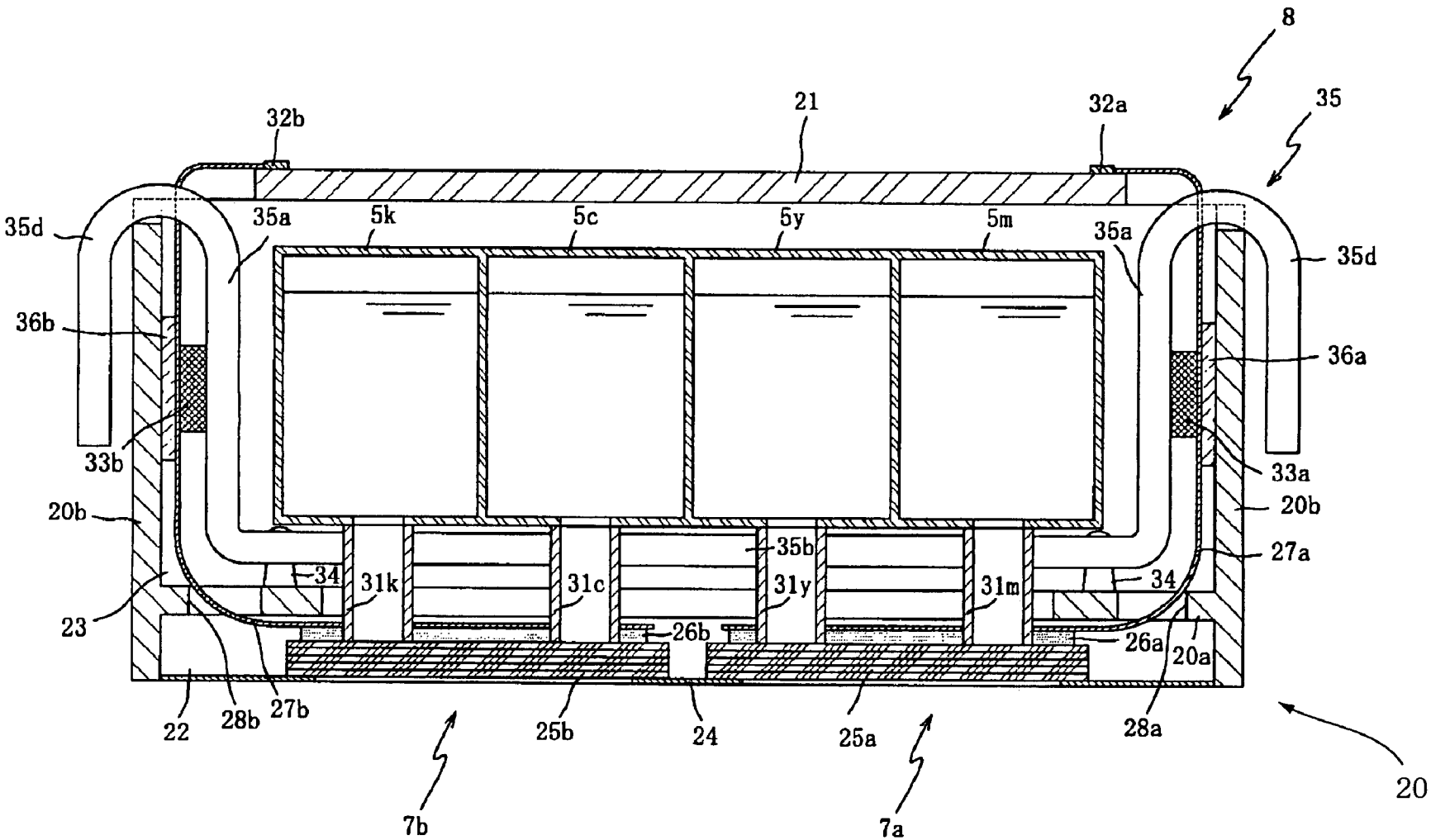
FIG. 2 is a cross-section view of a recording head unit of the recording apparatus.
Figure 3:
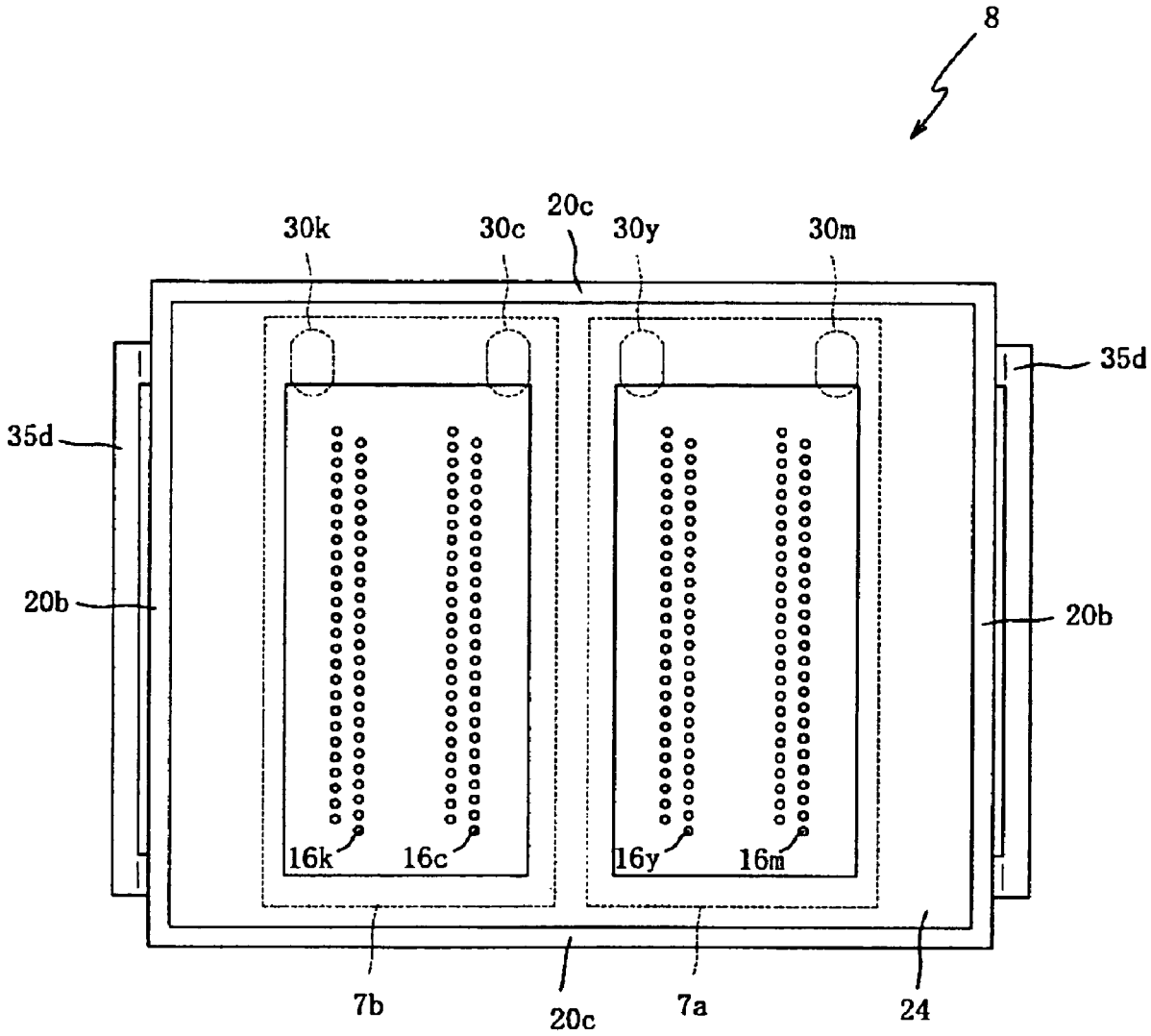
FIG. 3 is a bottom view of the recording head unit.

As shown in FIG. 4, each of the two flexible flat cables 27*a*, 27*b* has a great width in the first direction in which the arrays of electrodes 41 or the arrays of nozzles 16 extend and, as shown in FIG. 2, the two flexible cables 27*a*, 27*b* extend from the corresponding recording heads 7*a*, 7*b* in opposite directions, respectively, parallel to the second direction perpendicular to the first direction. The bottom wall 20 of the head holder 20 has two elongate communication passages 28*a*, 28*b* through which the two flexible cables 27*a*, 27*b* extend from the first or lower space 22 into the second or upper space 23. The two flexible cables 27*a*, 27*b* further extend upward substantially parallel to the two opposite side walls 20*b* of the head holder 20, respectively, that are located on either side of the two recording heads 7*a*, 7*b* in the second direction. End terminals 43*a* of the first flexible cable 27*a* are connected to respective connectors 32*a* of the printed circuit board 21 provided on top of the head holder 20 and, likewise, end terminals, not shown, of the second flexible cable 27*b* are connected to respective connectors 32*b* of the printed circuit board 21.

Each of the two IC chips 33*a*, 33*b* is provided at a substantially middle height position between the printed circuit board 21 and a corresponding one of the two recording heads 7*a*, 7*b*. Thus, an amount of heat generated by the each IC chip 33*a*, 33*b* and conducted to the corresponding recording head 7*a*, 7*b* is reduced. The above-indicated substantially middle height position is as level as a substantially middle height position of a corresponding one of the two side walls 20*b* each extending upward from the bottom wall 20*a*. However, each of the IC chips 33*a*, 33*b* may be provided at any position, so long as the amount of heat generated by the each IC chip 33*a*, 33*b* and conducted to the corresponding recording head 7*a*, 7*b* can be reduced. Preferably, each of the IC chips 33*a*, 33*b* may be provided at a height position between the printed circuit board 21 and the above-indicated substantially middle height position.

Figure 5:
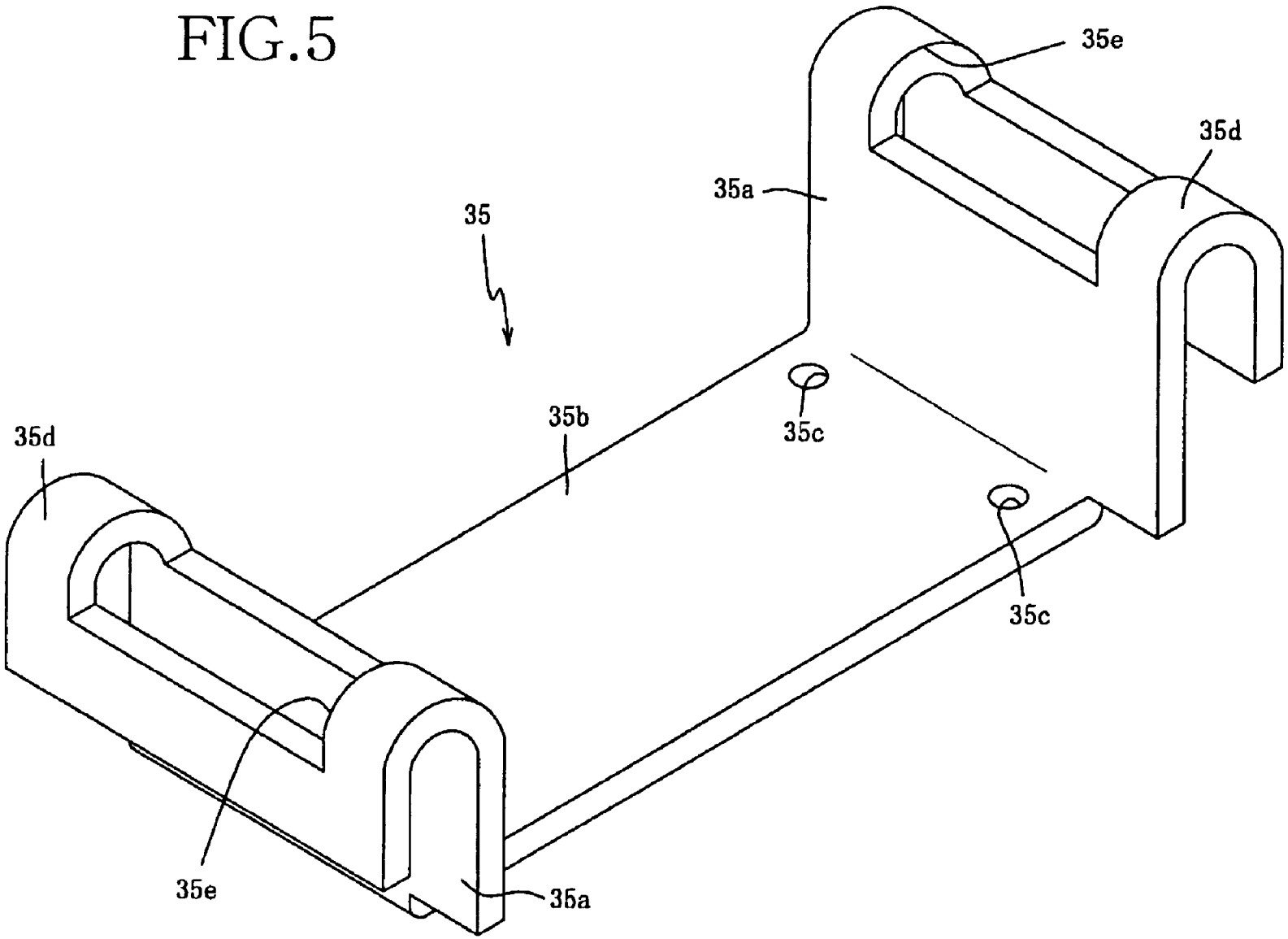
FIG. 5 is an enlarged, perspective view of a heat sink of the recording head unit.

The recording head unit 8 additionally includes a heat sink 35 that radiates the heat generated by the two IC chips 33*a*, 33*b*. As shown in FIG. 5, the heat sink 35 includes a pair of opposite side walls 35*a*, 35*a* and a connection portion 35*b* that connects between the two side walls 35*a*, 35*a*.

As shown in FIG. 2, the two side walls 35*a*, 35*a* are provided inside the two opposite side walls 20*b*, 20*b* of the head holder 20, respectively, that are provided on either side of the two recording heads 7*a*, 7*b* in the second direction, such that the two side walls 35*a*, 35*a* are spaced from, and extend parallel to, the two side walls 20*b*, 20*b*, respectively. The two flexible flat cables 27*a*, 27*b* extend through respective spaces left between the two side walls 35*a*, 35*a* and the corresponding side walls 20*b*, 20*b*. Two rubber-based elastic members 36*a*, 36*b* each functioning as a biasing member are fixedly adhered to the two side walls 20*b*, 20*b*, respectively, and bias the two IC chips 33*a*, 33*b* toward the corresponding side walls 35*a*, 35*a* of the heat sink 35, such that the heat generated by the IC chips 33*a*, 33*b* can be conducted to the corresponding side walls 35*a*, 35*a*.

The heat sink 35 additionally includes two exposed portions 35*d*, 35*d* that are extended from respective upper ends of the corresponding side walls 35*a*, 35*a*, over respective upper ends of the two side walls 20*b*, 20*b* of the head holder 20, and that are exposed to the outside space. Each of the two side walls 35*a*, 35*a* and a corresponding one of the two exposed portions 35*d*, 35*d* cooperate with each other to have an inverted-U-shaped cross section. The heat sink 35 has two elongate through-holes 35*e*, 35*e* that are formed through the respective curved upper ends of the two exposed portions 35*d*, 35*d*. Through the two through-holes 35*e*, 35*e*, the two flexible flat cables 27*a*, 27*b* extend, respectively, from the inner space of the head holder 20 to the printed circuit board 21.

The connection portion 35*b* of the heat sink 35 extends in the second direction in which the two recording heads 7*a*, 7*b* are arranged, and connects the two side walls 35*a*, 35*a* to each other such that heat can be conducted from one, to the other, of the two side walls 35*a*, 35*a*. In the present embodiment, the connection portion 35*b* extends in a space left between the four buffer tanks 5*m*, 5*y*, 5*c*, 5*k* and the bottom wall 20*a* of the head holder 20.

The heat sink 35 including the two side walls 35*a*, 35*a*, the connection portion 35*b*, and the two exposed portions 35*d*, 35*d* is produced by bending a single metallic sheet, such as an aluminum sheet, that has a high heat-radiating property. The heat sink 35 is fixed to the head holder 20, in such a manner that four holes 35*c* (FIG. 5) formed in the connection portion 35*b* of the heat sink 35 are fixed to four bosses 34 (FIG. 2) projecting from the bottom wall 20*a* of the head holder 20.

As is apparent from the foregoing description of the ink jet recording apparatus, the two flexible flat cables 27*a*, 27*b* are connected to the two recording heads 7*a*, 7*b*, respectively, such that the two flexible cables 27*a*, 27*b* extend in the second direction substantially perpendicular to the first direction in which the arrays of nozzles 16*m*, 16*y*, 16*c*, 16*k* extend. Therefore, in contrast to the conventional ink jet recording apparatus in which the flexible flat cables extend in the first direction, each of the two flexible cables 27*a*, 27*b* can enjoy the great width and accordingly a sufficiently low density at which the electric wires thereof are formed. Thus, the electric wires of each of the flexible cables 27*a*, 27*b* can be easily formed, and the production cost of each flexible cable 27*a*, 27*b* can be reduced. In addition, the total number of the nozzles 16*m*, 16*y*, 16*c*, 16*k* corresponding to each of the color inks can be easily increased.

In addition, in the illustrated embodiment, the two flexible flat cables 27*a*, 27*b* extend from the two recording heads 7*a*, 7*b* in the opposite directions, respectively, and accordingly the two IC chips 33*a*, 33*b* are located apart from each other. However, the two side walls 35*a*, 35*a* of the heat sink 35 that are held in contact with the two IC chips 33*a*, 33*b*, respectively, are connected to each other by the connection portion 35*b*. Therefore, even if only one of the two recording heads 7*a*, 7*b* may continuously eject the corresponding color ink or inks, the heat generated by the corresponding one of the two IC chips 33*a*, 33*b* is conducted from the corresponding one of the two side walls 35*a*, 35*a* to the other side wall 35*a* via the connection portion 35*b*, so that the heat can be radiated from the two side walls 35*a*, 35*a*, the connection portion 35*b*, and the two exposed portions 35*d*, 35*d*. Thus, an excessive increase of temperature of each of the two IC chips 33*a*, 33*b* can be prevented, and accordingly an excessive difference of respective temperatures of the IC chips 33*a*, 33*b* can be prevented. Consequently respective signal-outputting characteristics of the two IC chips 33*a*, 33*b* can be prevented from being adversely changed by the excessive temperature increase, and respective ink-ejecting characteristics of the nozzles 16*m*, 16*y*, 16*c*, 16*k* can be prevented from being largely deviated from each other by the excessive temperature difference. Thus, the ink jet recording apparatus 1 can record a full-color image with a high quality.

In addition, the heat sink 35 has a generally U-shaped cross section because of including the two side walls 35*a*, 35*a* and the connection portion 35*b*, and is fixed to the head holder 20 such that the two side walls 35*a*, 35*a* extend along the two side walls 20*b*, 20*b*, respectively, and the connection portion 35*b* extends along the bottom wall 20*a*. Thus, the heat sink 35 can be produced in such a shape and a size that are suitable for the shape and size of the head holder 20, which leads to reducing the overall size of the recording head unit 8. In addition, since the heat sink 35 includes the two exposed portions 35*d*, 35*d* that are extended from the two side walls 35*a*, 35*a* over the respective upper ends of the two side walls 20*b*, 20*b* of the head holder 20, are exposed to the outside space, and are located on either side of the head holder 20 in the second direction in which the carriage 9 is moved, the heat sink 35 can exhibit an improved heat radiating effect when the carriage 9 is moved.

Figure 6:
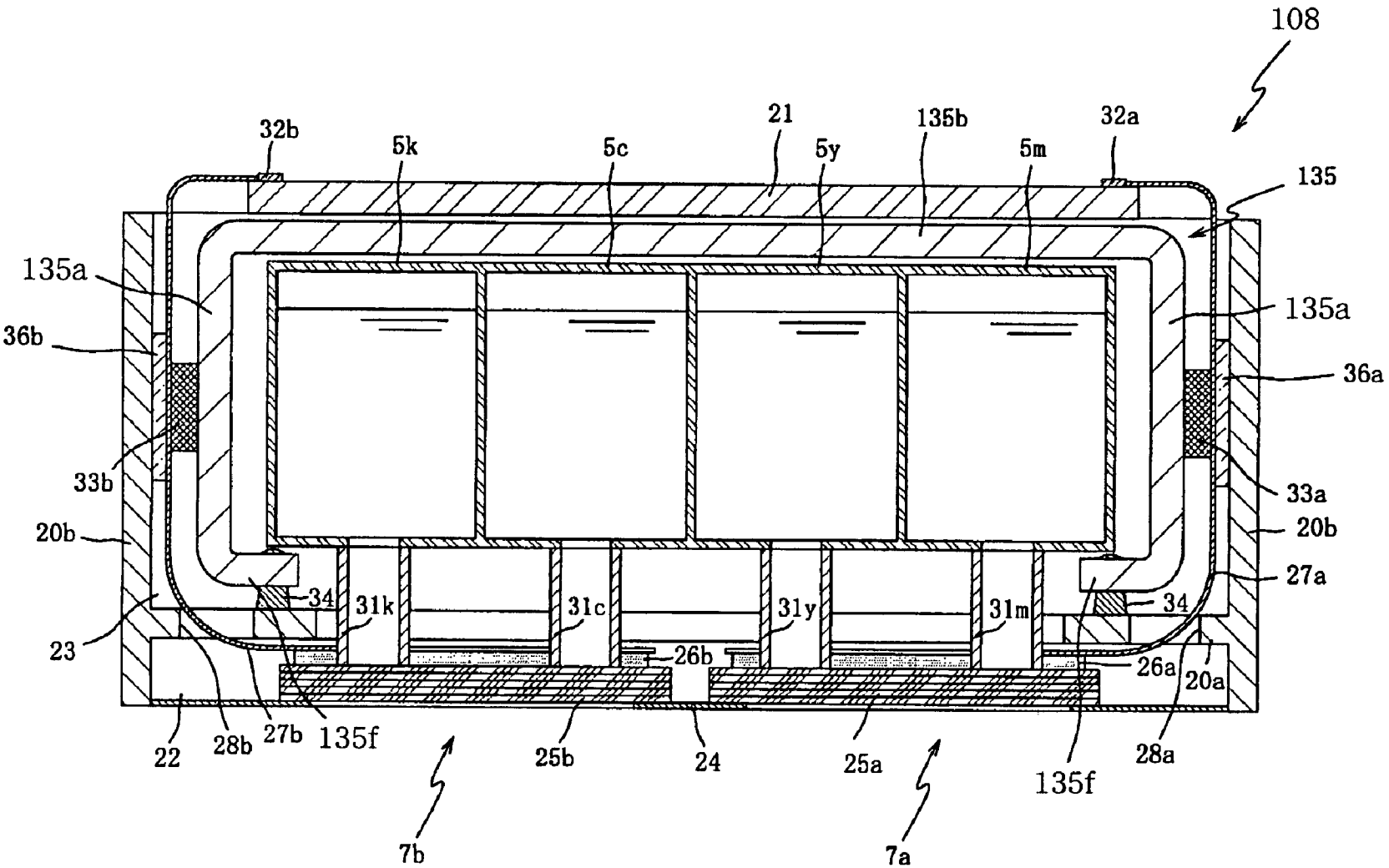
FIG. 6 is a cross-section view corresponding to FIG. 2, showing another recording head unit as a second embodiment of the present invention.
Figure 7:
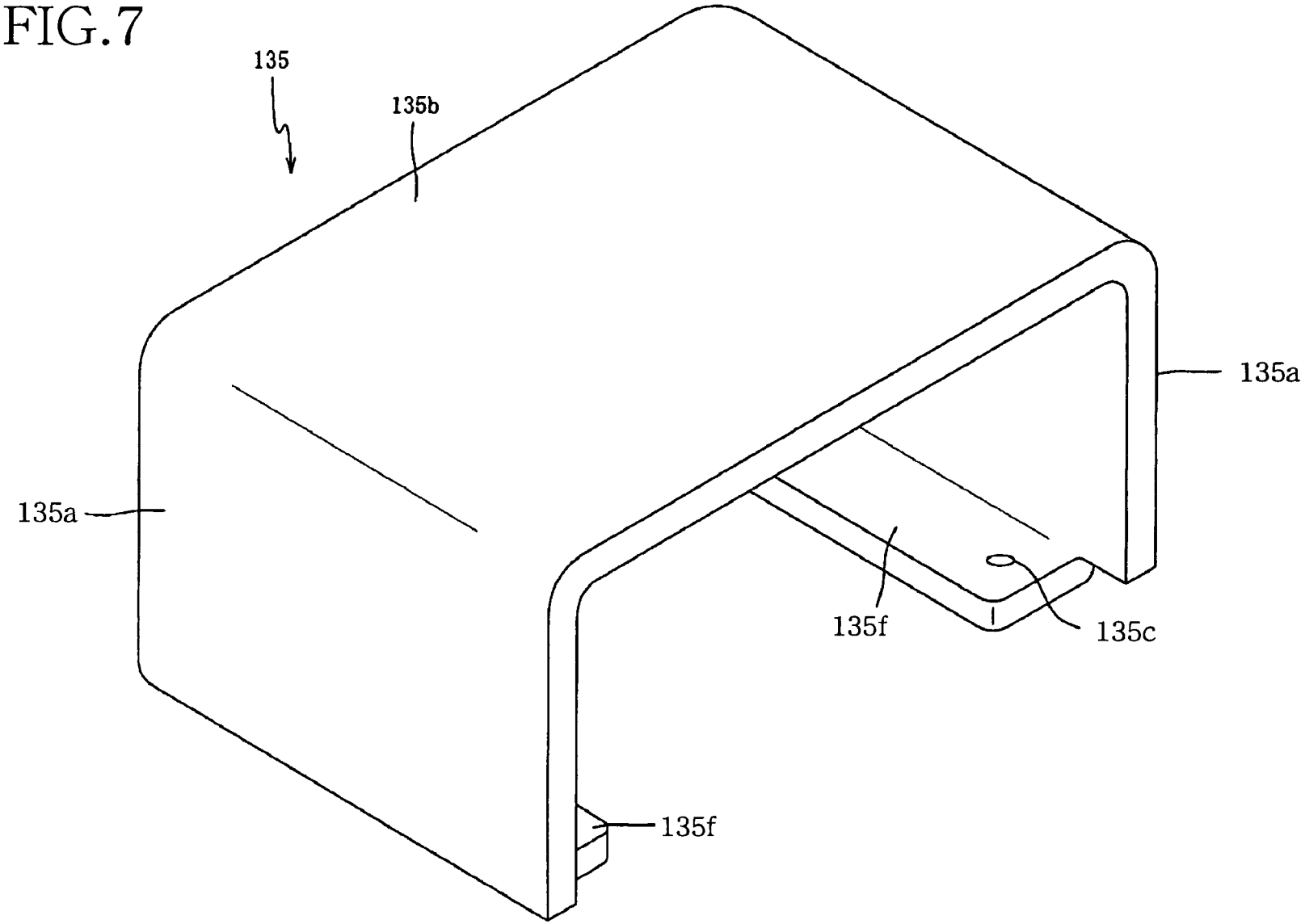
FIG. 7 is an enlarged, perspective view corresponding to FIG. 5, showing a heat sink of the recording head unit of FIG. 6.

Next, there will be described a second embodiment of the present invention, by reference to FIGS. 6 and 7. The same reference numerals as used in the first embodiment shown in FIGS. 1 through 5, are used to designate the corresponding elements and parts of the second embodiment, and the description of those elements and parts is omitted. FIG. 6 shows a recording head unit 108 that may be employed by the ink jet recording apparatus shown in FIG. 1, in place of the recording head unit 8; and FIG. 7 shows a heat sink 135 that is employed by the recording head unit 108.

The heat sink 135 employed by the ink jet recording head 108 includes two side walls 135*a*, 135*a* extending substantially parallel to two side walls 20*b*, 20*b* of a head holder 20; a connection portion 135*b* that is provided in a space left between four buffer tanks 5 (5*m*, 5*y*, 5*c*, 5*k*) and a printed circuit board 21, and connects between the two side walls 135*a*, 135*a* ; and two fixation portions 135*f*, 135*f* that are fixed to four bosses 34 projecting upward from a bottom wall 20*a* of the head holder 20. Each of the two fixation portions 135*f*, 135*f* has two holes 135*c*, 135*c* that are fixed to the corresponding two bosses 34, respectively.

More specifically described, the connection portion 135*b* of the heat sink 135 extends in the first and second directions along respective upper walls of the four buffer tanks 5, over an area substantially equal to a sum of respective areas of those upper walls. Thus, the heat sink 135 has large outer surfaces located in the head holder 20, and accordingly can enjoy an improved heat radiating property.

Figure 8:
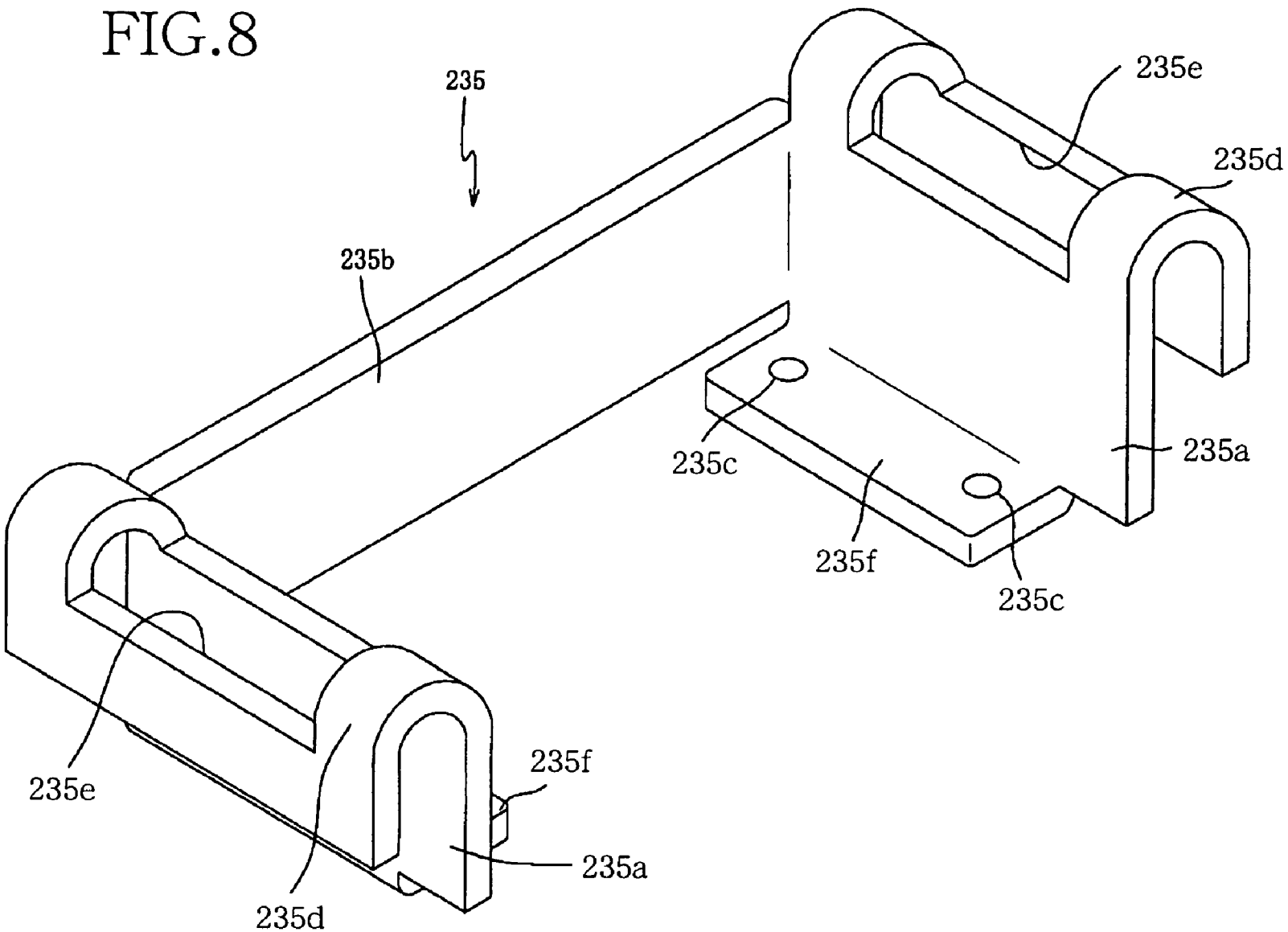
FIG. 8 is an enlarged, perspective view corresponding to FIG. 5, showing another heat sink as a third embodiment of the present invention.

FIG. 8 shows another heat sink 235 as a third embodiment of the present invention. The heat sink 235 may be employed by the recording head unit 8 shown in FIG. 1, in place of the heat sink 35.

The heat sink 235 includes a connection portion 235*b* that extends along respective rear side walls of four buffer tanks 5 (5*m*, 5*y*, 5*c*, 5*k*). Like the heat sink 35 and/or the heat sink 135, the heat sink 235 additionally includes two side walls 235*a*, 235*a*, two exposed portions 235*d*, 235*d*, two through-holes 235*e*, 235*e*, two fixation portions 235*f*, 235*f*, and four holes 235*c*. Since the connection portion 235*b* has an area substantially equal to a sum of respective areas of the respective rear side walls of the four buffer tanks 5, the heat sink 235 can enjoy an improved heat radiating property.

In each of the illustrated embodiments, the ink jet recording apparatus employs the head holder 20 including the bottom wall 20*a* that supports the recording heads 7, and additionally including the two side walls 20*b*, 20*b* that are opposite to each other in the second direction and extend upward from the two opposite ends of the bottom wall 20*a*, respectively. The buffer tanks 5 that store the color inks to be supplied to the recording heads 7, are provided in the head holder 20. The heat sink 35, 135, 235 is provided such that the two side walls 35*a*, 135*a*, 235*a* of the heat sink extend parallel to the two side walls 20*b* of the head holder 20, respectively, and such that the connection portion 35*b*, 135*b*, 235*b* of the heat sink extends along the respective outer surfaces of the buffer tanks 5. Therefore, the buffer tanks 5, the recording heads 7, and the head holder 20 can be assembled into a structure having a reduced size as a whole. In addition, since the connection portion 35*b*, 135*b*, 235*b* extends along the buffer tanks 5 and connects between the two side walls 35*a*, 135*a*, 235*a* extending parallel to the two side walls 20*b* of the head holder 20, respectively, the connection portion 35*b*, 135*b*, 235*b* can have a large amount of surfaces that are exposed to the ambient air. Thus, the heat sink 35, 135, 235 can efficiently radiate the heat generated by the IC chips 33 as the driver circuits.

In the first or third embodiment, the two side walls 35*a*, 235*a* of the heat sink 35, 235 are provided inside the two side walls 20*b* of the head holder 20, respectively, and the heat sink further includes the two exposed portions 35*d*, 235*d* that are extended from the two side walls 35*a*, 135*a* thereof over the respective upper ends of the two side walls 20*b* of the head holder 20 and each of which is exposed to the outside space. Thus, the heat sink 35, 235 can have an increased amount of surfaces that are exposed to the ambient air. Thus, the heat sink 35, 235 can more efficiently radiate the heat generated by the IC chips 33 as the driver circuits.

In the first or third embodiment, the ink jet recording apparatus includes the printed circuit board 21 that is provided above the buffer tanks 5 and is electrically connected to the two flat cables 27, and the two side walls 35*a*, 235*a* of the heat sink 35, 235 has the respective through-holes 35*e*, 235*e* through which the two flat cables 27 extend from the two recording heads 7 to the printed circuit board 21. Therefore, the two flat cables 27 can be connected to the printed circuit board 21 provided above the buffer tanks 5, through the respective through-holes 35*e*, 235*e* of the two side walls 35*a*, 235*a*, without being interfered with by the respective exposed portions 35*d*, 235*d* of the heat sink 35, 235 that are extended from the two side walls 35*a*, 235*a* thereof. In addition, the two flat cables 27 can be easily connected to the printed circuit board 21. Even if the printed circuit board 21 may fail, the board 21 can be replaced with a new one conveyed in a downward direction, or repaired with a person's hand conveyed in the same direction. Thus, the maintenance of the present ink jet recording apparatus can be easily carried out.

In each of the first to third embodiments, the heat sink 35, 135, 235 including the two side walls 35*a*, 135*a*, 235*a* and the connection portion 35*b*, 135*b*, 235*b* is constituted by the integral, bent metallic sheet. Thus, the heat sink 35, 135, 235 can be manufactured at a low cost.

In each of the first to third embodiments, each of the IC chips 33 as the driver circuits is provided between the printed circuit board 21, and the middle height position between the printed circuit board 21 and a corresponding one of the recording heads 7. Therefore, the amount of heat generated by each of the IC chips 33 and conducted to the corresponding recording head 7 can be reduced. If the respective temperatures of the recording heads 7 were excessively increased, respective operation characteristics of the individual piezoelectric actuators of the actuator units 26 would change and/or respective viscosities of the color inks would change, so that each of the recording heads 7 would probably fail to record an excellent full-color image. However, since the heat sink 35, 135, 235 can effectively reduce the amount of heat conducted from each of the IC chips 33 to the corresponding recording head 7, it can minimize the possibility that each of the recording heads 7 may fail to record an excellent full-color image.

In the first or third embodiment, the ink jet recording apparatus includes the housing 1 and the carriage 9 that is moved in the housing 1 relative thereto, and the head holder 20 is mounted on the carriage 9 such that the two exposed portions 35*d*, 235*d* of the heat sink 35, 235 are opposite to each other in the second direction in which the carriage 9 is moved relative to the recording sheet 6. Therefore, when the carriage 9 is moved for the recording heads 7 to record an image on the recording sheet 6, the heat sink 35, 235 can effectively radiate the heat generated by the IC chips 33.

In each of the first to third embodiments, the two recording heads 7*a*, 7*b* having the respective arrays of nozzles 30 are employed. However, the present invention is applicable to an ink jet recording apparatus employing a single recording head having two groups of piezoelectric deformable portions, i.e., two groups of pressure changing devices that are arranged in a single array in the first direction. In this case, first alternative ones of the pressure changing devices arranged in the single array may belong to a first group of the two groups; and second alternative ones, i.e., every second ones of the pressure changing devices may belong to the second group. Also, in this case, the ink ejection nozzles 30 may be arranged in a single array parallel to the single array of pressure changing devices in the first direction.

It is to be understood that the present invention may be embodied with various changes, modifications, and improvements that may occur to a person skilled in the art, without departing from the spirit and scope of the invention defined in the appended claims.

What is claimed is:

1. An ink jet recording apparatus, comprising:

a plurality of nozzles each of which ejects a droplet of at least one sort of ink toward a recording medium and which are arranged in at least one array in a first direction;

a plurality of pressure changing devices which correspond to the nozzles, respectively, and each of which changes a pressure of said at last one sort of ink to be supplied to a corresponding one of the nozzles so that said one nozzle ejects the droplet of said at least one sort of ink, wherein the pressure changing devices are grouped into two groups which are arranged in a second direction substantially perpendicular to the first direction;

two flexible wiring cables which are electrically connected to the two groups of pressure changing devices, respectively, and which extend from the two groups of pressure changing devices in opposite directions, respectively, that are parallel to the second direction and away from each other;

two driver circuits which are provided on, and electrically connected to, the two wiring cables, respectively, and each of which outputs respective drive signals to drive the respective pressure changing devices of a corresponding one of the two groups; and a heat sink including two heat-conducting side walls which are opposite to each other in the second direction, a portion of each one of the two side walls contacting a corresponding one of the two driver circuits, and a heat-conducting connection portion which extends in the second direction and connects between the two side walls.

2. The ink jet recording apparatus according to claim 1, further comprising two recording heads which cooperate with each other to have a plurality of pressure chambers each of which accommodates said at least one sort of ink and communicates with a corresponding one of the plurality of nozzles, wherein the plurality of nozzles are grouped into two groups corresponding to the two groups of pressure changing devices, respectively, and the plurality of pressure chambers are grouped into two groups corresponding to the two groups of pressure changing devices, respectively, wherein the nozzles of each of the two groups are arranged in at least one array in the first direction, and wherein the two groups of nozzles belong to the two recording heads, respectively, the two groups of pressure chambers belong to the two recording heads, respectively, and the two groups of pressure changing devices belong to the two recording heads, respectively.

3. The ink jet recording apparatus according to claim 1, further comprising:

a head holder including a bottom wall which supports at least one recording head having the nozzles and the pressure changing devices, and additionally including two side walls which are opposite to each other in the second direction and extend upward from two opposite ends of the bottom wall, respectively; and at least one buffer tank which is provided in the head holder and which accommodates said at least one sort of ink to be supplied to said at least one recording head, wherein the heat sink is supported by the head holder such that the two side walls of the heat sink extend parallel to the two side walls of the head holder, respectively, and the connection portion of the heat sink extends along an outer surface of said at least one buffer tank.

4. The ink jet recording apparatus according to claim 3, wherein the two side walls of the heat sink are provided inside the two side walls of the head holder, respectively, and wherein the heat sink further includes two exposed portions which are extended from the two side walls thereof over respective upper ends of the two side walls of the head holder and each of which is exposed to an outside space outside the head holder.

5. The ink jet recording apparatus according to claim 4, further comprising a housing, and a carriage which is moved relative to the housing in the second direction, wherein the head holder is mounted on the carriage such that the two exposed portions of the heat sink supported by the head holder are opposite to each other in the second direction.

6. The ink jet recording apparatus according to claim 3, further comprising at least one printed circuit board which is provided above said at least one buffer tank and is electrically connected to each of the two wiring cables.

7. The ink jet recording apparatus according to claim 6, wherein the two side walls of the heat sink has respective through-holes through which the two wiring cables extend from said at least one recording head to said at least one printed circuit board.

8. The ink jet recording apparatus according to claim 6, wherein each of the two driver circuits is provided at a position between said at least one printed circuit board, and a middle position between said at least one printed circuit board and said at least one recording head.

9. The ink jet recording apparatus according to claim 3, wherein said at least one recording head further has a plurality of pressure chambers which correspond to the pressure changing devices, respectively, and each of which accommodates said at least one sort of ink and communicates, at one end thereof, with said at least one buffer tank and, at an other end thereof, with a corresponding one of the nozzles, and wherein when each of the pressure changing devices changes the pressure of said at least one sort of ink accommodated by a corresponding one of the pressure chambers, a corresponding one of the nozzles ejects a droplet of said at least one sort of ink toward the recording medium.

10. The ink jet recording apparatus according to claim 3, further comprising two biasing members each of which is provided between a corresponding one of the two flexible wiring cables and a corresponding one of the two side walls of the head holder and biases a corresponding one of the two driver circuits toward a corresponding one of the two side walls of the heat sink.

11. The ink jet recording apparatus according to claim 3, wherein the heat sink is supported by the head holder such that the connection portion of the heat sink extends along a lower surface of said at least one buffer tank and the two side walls of the heat sink extend upward from the connection portion thereof, parallel to the two side walls of the head holder, respectively.

12. The ink jet recording apparatus according to claim 3, wherein the heat sink is supported by the head holder such that the connection portion of the heat sink extends along an upper surface of said at least one buffer tank.

13. The ink jet recording apparatus according to claim 3, wherein the heat sink is supported by the head holder such that the connection portion of the heat sink extends along a side surface of said at least one buffer tank.

14. The ink jet recording apparatus according to claim 1, wherein the heat sink including the two side walls and the connection portion is constituted by a bent integral sheet.

15. The ink jet recording apparatus according to claim 1, wherein the plurality of nozzles are arranged, in the first direction, in a plurality of arrays grouped into two groups which are arranged in the second direction and which correspond to the two groups of pressure changing devices, respectively, wherein the nozzles of each of the two groups eject a droplet of a corresponding one of two sorts of inks toward the recording medium, and wherein the pressure changing devices of each of the two groups change a pressure of a corresponding one of the two sorts of inks to be supplied to the nozzles of a corresponding one of the two groups.

16. The ink jet recording apparatus according to claim 1, wherein the two side walls of the heat sink extend in a third direction substantially perpendicular to the first and second directions.

17. An ink jet recording apparatus, comprising:

a plurality of nozzles each of which ejects a droplet of at least one sort of ink toward a recording medium;

a plurality of pressure changing devices which correspond to the nozzles, respectively, and each of which changes a pressure of said at last one sort of ink to be supplied to a corresponding one of the nozzles so that said one nozzle ejects the droplet of said at least one sort of ink, wherein the pressure changing devices are grouped into two groups;

two flexible wiring cables which are electrically connected to the two groups of pressure changing devices, respectively, and which extend from the two groups of pressure changing devices in opposite directions, respectively, that are away from each other;

two driver circuits which are provided on, and electrically connected to, the two wiring cables, respectively, and each of which outputs respective drive signals to drive the respective pressure changing devices of a corresponding one of the two groups; and a heat sink including two heat-conducting side walls which are opposite to each other in a parallel direction parallel to said opposite directions, a portion of each one of the two side walls contacting a corresponding one of the two driver circuits, and a heat-conducting connection portion which extends in said parallel direction and connects between the two side walls.

18. The ink jet recording apparatus according to claim 17, further comprising:

a head holder including a bottom wall which supports at least one recording head having the nozzles and the pressure changing devices, and additionally including two side walls which are opposite to each other in said parallel direction and extend upward from two opposite ends of the bottom wall, respectively; and at least one buffer tank which is provided in the head holder and which accommodates said at least one sort of ink to be supplied to said at least one recording head, wherein the heat sink is supported by the head holder such that the connection portion of the heat sink extends along a lower surface of said at least one buffer tank and the two side walls of the heat sink extend upward from the connection portion thereof, parallel to the two side walls of the head holder, respectively.

19. The ink jet recording apparatus according to claim 17, wherein the nozzles are arranged in at least one array in a first direction and the pressure changing devices are grouped into two groups which are arranged in a second direction substantially perpendicular to the first direction, and wherein the two side walls of the heat sink extend in a third direction substantially perpendicular to the first and second directions.

20. The ink jet recording apparatus according to claim 17, wherein the heat sink radiates a heat generated by said each of the driver circuits, said portion of said each one of the two side walls contacts said corresponding one of the two driver circuits such that the heat generated by said one driver circuit is conducted to said each one side wall, and the connection portion conducts, from said each one side wall to an other of the two side walls, the heat generated by said one driver circuit.

21. An ink jet recording apparatus, comprising:

a plurality of nozzles each of which ejects a droplet of at least one sort of ink toward a recording medium and which are arranged in at least one array in a first direction;

a plurality of pressure changing devices which correspond to the nozzles, respectively, and each of which changes a pressure of said at last one sort of ink to be supplied to a corresponding one of the nozzles so that said one nozzle ejects the droplet of said at least one sort of ink, wherein the pressure changing devices are grouped into two groups which are arranged in a second direction substantially perpendicular to the first direction;

two flexible wiring cables which are electrically connected to the two groups of pressure changing devices, respectively, and which extend from the two groups of pressure changing devices in opposite directions, respectively, that are parallel to the second direction and away from each other;

two driver circuits which are provided on, and electrically connected to, the two wiring cables, respectively, and each of which outputs respective drive signals to drive the respective pressure changing devices of a corresponding one of the two groups; and a heat sink which radiates a heat generated by said each of the driver circuits, wherein the heat sink includes two side walls which are opposite to each other in the second direction and a portion of each one of which contacts a corresponding one of the two driver circuits such that the heat generated by said one driver circuit is conducted to said each one side wall, and a connection portion which extends in the second direction, connects between the two side walls, and conducts, from said each one side wall to an other of the two side walls, the heat generated by said one driver circuit.

22. The ink jet recording apparatus according to claim 21, further comprising:

a head holder including a bottom wall which supports at least one recording head having the nozzles and the pressure changing devices, and additionally including two side walls which are opposite to each other in the second direction and extend upward from two opposite ends of the bottom wall, respectively; and at least one buffer tank which is provided in the head holder and which accommodates said at least one sort of ink to be supplied to said at least one recording head, wherein the heat sink is supported by the head holder such that the connection portion of the heat sink extends along a lower surface of said at least one buffer tank and the two side walls of the heat sink extend upward from the connection portion thereof, parallel to the two side walls of the head holder, respectively.

23. The ink jet recording apparatus according to claim 21, wherein the two side walls of the heat sink extend in a third direction substantially perpendicular to the first and second directions.

* * * * *